US006279335B1

(12) United States Patent
Jacobs

(10) Patent No.: US 6,279,335 B1
(45) Date of Patent: Aug. 28, 2001

(54) REFRIGERATED CASE COVER

(76) Inventor: Michael T. Jacobs, 537 Sandy Oaks Blvd., Ormond Beach, FL (US) 32174

( * ) Notice: Subject to any disclaimer, the term of this patent is extended or adjusted under 35 U.S.C. 154(b) by 0 days.

(21) Appl. No.: 09/578,093

(22) Filed: May 25, 2000

(51) Int. Cl.[7] ..... A47F 3/04
(52) U.S. Cl. ..... 62/249; 160/327
(58) Field of Search ..... 62/246, 249, 255, 62/256; 160/327, 328, 368.1, 349.1; 312/116, 4

(56) References Cited

U.S. PATENT DOCUMENTS

| | | | | |
|---|---|---|---|---|
| 3,241,899 | | 3/1966 | Donker . | |
| 4,141,611 | | 2/1979 | De Leon . | |
| 4,186,790 | | 2/1980 | Schenker et al. . | |
| 4,288,992 | | 9/1981 | Eliason . | |
| 4,296,792 | | 10/1981 | Gidge et al. . | |
| 4,310,044 | | 1/1982 | Schenker . | |
| 4,392,360 | | 7/1983 | Gidge et al. . | |
| 4,429,548 | | 2/1984 | Layne . | |
| 4,550,760 | * | 11/1985 | Gidge et al. | 160/327 |
| 5,171,076 | | 12/1992 | Eming . | |
| 5,431,490 | | 7/1995 | Edwards . | |
| 5,454,611 | * | 10/1995 | Wanat | 294/24 |
| 6,102,076 | * | 8/2000 | Romero, Jr. et al. | 138/96 R |
| 6,197,077 | * | 3/2001 | Simmon et al. | 55/351 |

* cited by examiner

*Primary Examiner*—William E. Tapolcai
*Assistant Examiner*—Mohammad Mali
(74) *Attorney, Agent, or Firm*—Paul S. Rooy

(57) ABSTRACT

A refrigerated case cover and method of use. The refrigerated case cover comprises a cover sheet made of insulating material having air cells sandwiched between an outer cover sheet and an inner cover sheet. Eyelets are disposed along the top and bottom edges of the cover. A cord is woven through the lower eyelets. At least one male tab is disposed on each cover sheet side. The cover is attached to a refrigerated case by attaching the upper eyelets to an upper case front lip by means of S hooks, attaching the cord to grille spokes disposed along a lower case front upper edge with S hooks, and attaching each cover sheet side to a respective case side with hook and loop material. An alternate embodiment refrigerated case cover has weights disposed along the cover sheet lower edge, to keep the refrigerated case cover sealed against a refrigerated case lower front, and to expedite installation and removal of the refrigerated case cover. This alternate embodiment refrigerated case cover does not have lower eyelets nor a cord.

19 Claims, 4 Drawing Sheets

REFRIGERATED CASE COVER

BACKGROUND OF THE INVENTION

1. Field of the Invention

This invention relates to refrigeration of perishables, and in particular to a refrigerated case cover.

2. Background of the Invention

Refrigerated cases are in extensive use for cold storage of food. One type of refrigerated food storage case which is very common in supermarkets, food stores, and convenience stores is the open front merchandising case. This type of case comprises a cooling unit installed within an insulated case, and most of the front of the case is open in order to permit customers to easily remove the items desired. Shelves are typically provided on which to store the vendible items.

One such typical retail refrigerated case 2 is illustrated in FIGS. 1 and 2. FIG. 1 is a front quarter isometric view of an open front refrigerated case 2. FIG. 2 is a side cross-sectional view of refrigerated case 2 taken at section II—II of FIG. 1.

Referring now to these two figures, refrigerated case 2 comprises case front 4 and case sides 6. Case front opening 8 is disposed in case front 4; one case side opening 10 is disposed in each case side 6. Case front opening 8 communicates with case side openings 10.

Shelves 14 are disposed within refrigerated case 2 to support vendible refrigerated items. Refrigerated air emerges through grille 12 disposed along lower case front upper edge 20. Grille is comprised of grille apertures 16 separated by grille spokes 18. When provided the requisite electrical power, a modern refrigerated case 2 will maintain food cold enough for adequate preservation.

If electrical power to refrigerated case 2 is interrupted, however, refrigerated case 2 is no longer able to maintain the proper storage temperature, and sooner or later perishable items contained therein will spoil. Power interruptions may occur for a variety of reasons: there may be a problem with the electrical utility which provides power, wind storms may have downed lines, or in the case of a hurricane, power may be interrupted for days. Where a hurricane causes a prolonged power outage, all the perishable items in a refrigerated case may spoil, at considerable cost. For example, following a recent hurricane-induced power outage, the contents of only one refrigerated supermarket dairy case had to be discarded, at a cost of $20,000!

In addition, short of an actual power failure, it would be desirable to insulate case front opening 8 and case side openings 10 during periods that the store is closed, in order to reduce refrigeration costs. If these openings could be temporarily blocked during hours of store closure, less electrical power would be required to maintain the correct temperature inside refrigerated case 2. Given the number of food stores in existence, and the proliferation of refrigerated cases therein, the cumulative energy savings could be considerable.

Existing Designs

A number of solutions have been proposed to the problem of refrigeration failure caused by power outages. One scheme involves a stand-alone generator on-site which would kick in if power failed. A drawback to this solution is cost—a generator sufficiently large to power all the food refrigerators in a modern supermarket is very costly.

Another procedure used when a supermarket experiences what is forecast to be a lengthy power failure, involves moving all the food in open-front refrigerated cases into the walk-in freezer. Due to its closed construction, the walk-in freezer generally stays cold longer than any open-front refrigerated case. In addition, dry ice may be brought into the walk-in freezer to maintain its temperature. As long as the supply of dry ice is kept up, the temperature in the walk-in freezer can be maintained. One major problem associated with this procedure is the large amount of work required to first de-stock, and then after restoration of power re-stock, the open-front refrigerated cases. Another problem is the uncertainty of knowing when power will be restored: it would be a waste of manpower to de-stock the open-front cases, only to have power come back on just as the last case was de-stocked!

Still another procedure currently in use is to prop corrugated cardboard up over the front and side openings of open-face refrigerated cases in case of power failure. Unfortunately, the cardboard tends to get soggy due to water condensation on its inside face. Soggy cardboard is weak cardboard. Customers during a hurricane-induced power outage wishing to purchase food items stored in an open-face refrigerated case blocked by sodden cardboard generally just rip off the water-weakened cardboard, take what they want, and leave. The result is an open-face refrigerated case with no cover to help maintain temperature, and consequent food spoilage. Still another problem associated with using cardboard to maintain temperature inside an open-face refrigerated case is its lack of insulation value: corrugated cardboard provides very little insulation value.

A number of patents have been granted for open front refrigerated case covers. U.S. Pat. Nos. 4,392,360 and 4,141,611 were granted Gidge at al. and De Leon, respectively. The covers disclosed in these patents attached to a case front top by means of hook and loop material and "Y" hooks, respectively. The Gidge et al. '360 patent taught no insulation. Although the De Leon '611 taught insulation, it was fiber glass. If for some reason glass fibers were to escape from the De Leon '611 cover (e.g. due to cover breach or tearage due to folding, etc.), the glass fibers would sprinkle down over food contained in the case, which could constitute a health hazard to anyone subsequently eating the food. In addition, neither of these patents taught a means of securing the bottom of the cover to the case, so customers could easily move these covers aside to remove the refrigerated case contents, allowing the cold air to escape. Finally, both these designs required some modification to the refrigerated case (either holes drilled to accommodate the "J" hooks or hook and loop material mounted to the case front top), so installation required some effort.

Layne, Gidge et al. and Edwards were granted U.S. Pat. Nos. 4,429,548, 4,296,792 and 5,431,490 respectively for ribboned case cover designs. These designs provided a series of ribbons hanging vertically across the case openings. The ribbons were held in place by means of snaps, double-sided tape, or hinged doors (in the case of Layne). These designs suffered from the same disadvantage as the previous two patents: no means of preventing customer access and the attendant loss of cold air was taught. In addition, these designs required some modification to the refrigerated case (permanent installation of doors, snaps, or double-sided tape placement), so installation was permanent and required some effort.

Yet another class of refrigerated case covers were taught in U.S. Pat. Nos. 5,171,076, 4,310,044, 4,288,992, 4,186,790, and 3,241,899, granted to Eming, Schencker, Eliason, Schenker et al. and Donker respectively. These devices were relatively complex, and all taught some means of rolling up the cover in order to retract it. These designs suffered from the disadvantages of complexity, and attendant high cost. In addition, they required permanent installation, and modification to the refrigerated case in which they were installed, thus increasing the cost of installation. Many of these designs taught a ribboned cover, or one which was not secured to the case along its bottom, which allowed customers to open them during power failures, which would allow the cold air to escape.

SUMMARY OF THE INVENTION

Accordingly, it is an object of the present invention to provide a refrigerated case cover which is easily installed and removed from an existing open face refrigerated case. Design features allowing this object to be accomplished include a pre-sized cover sheet having eyelets along its upper and lower edges, a cord woven through the lower eyelets, S hooks attaching the upper eyelets to an upper case front lip and the cord to case grille spokes, and hook and loop material attaching the cover sheet sides to the refrigerated case sides. Advantages associated with the accomplishment of this object include quick reaction time to power outages, thus minimizing the chances that any food spoilage will occur, and minimal installation/removal time, thus saving time and money.

It is another object of the present invention to provide a refrigerated case cover which prevents customers from opening it. Design features allowing this object to be accomplished include upper and lower S hooks, and hook and loop material attaching the cover to the refrigerated case. Benefits associated with the accomplishment of this object include reduced loss of cold air from the refrigerated case, and consequently less chance of food spoilage.

It is still another object of this invention to provide a refrigerated case cover which incorporates superior cover sheet insulation. Design features enabling the accomplishment of this object include an outer cover sheet separated from an inner cover sheet by a plurality of air cells, and the method step of putting dry ice into the case as necessary to provide cooling. Advantages associated with the realization of this object include increased cover sheet insulation, less chance of food spoilage, and avoidance of incurring the cost of replacing spoiled food.

It is another object of the present invention to provide a refrigerated case cover which may be quickly and easily attached to another adjacent refrigerated case cover. Design features allowing this object to be accomplished include at least one male end tab having hook and loop material attached to a cover sheet side edge of one refrigerated case cover, and at least one female end tab having hook and loop material attached to an adjacent cover sheet side edge of the other refrigerated case cover. A benefit associated with the accomplishment of this object is flexibility of installation of refrigerated case covers, even when dealing with oversized refrigerated cases.

It is still another object of this invention to provide a refrigerated case cover which is sturdy and unlikely to weaken and rip in the presence of humidity and condensate. Design features enabling the accomplishment of this object include a cover sheet manufactured of aluminum sheet. Advantages associated with the realization of this object include increased cover longevity, less chance that customers will break the cover sheet while attempting to get into the refrigerated case it protects, and consequent decreased cost over time.

It is another object of the present invention to provide a refrigerated case cover which requires little or no modification to a refrigerated case upon which it is to be installed. Design features allowing this object to be accomplished include a cover sheet having eyelets along its upper and lower edges, a cord woven through the lower eyelets, S hooks attaching the upper eyelets to an existing upper case front lip and the cord to existing case grille spokes, and hook and loop material attaching the cover sheet sides to the refrigerated case sides. Benefits associated with the accomplishment of this object include less installation time, preservation of the resale value of the refrigerated case in question, and consequent cost savings.

It is yet another object of this invention to provide a refrigerated case cover which incorporates mainly off-the-shelf materials and components. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Four sheets of drawings are provided. Sheet one contains FIGS. 1 and 2. Sheet two contains FIGS. 3 and 4. Sheet three contains FIGS. 5 and 6. Sheet four contains FIGS. 7 and 8.

DETAILED DESCRIPTION OF THE PREFERRED EMBODIMENT

Figure 1:
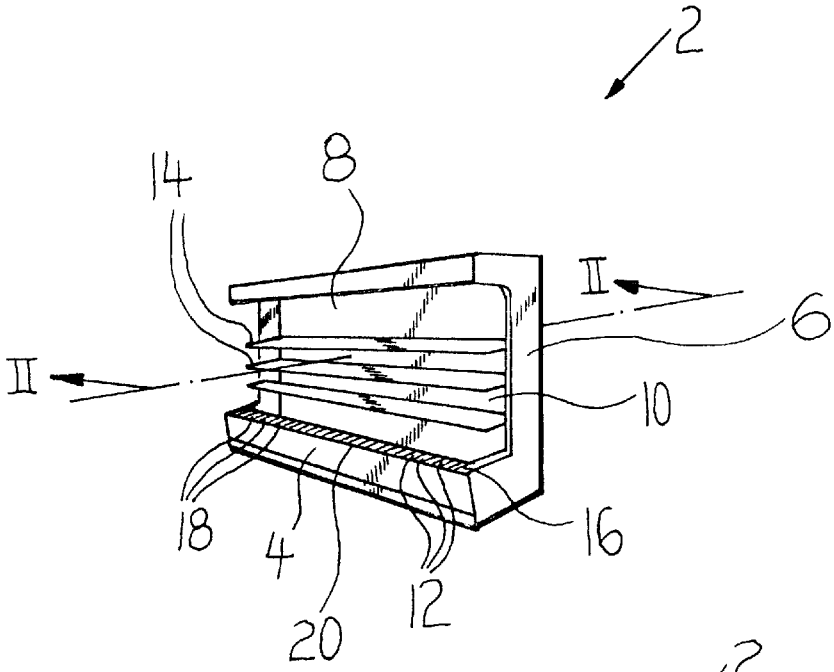
FIG 1 PRIOR ART
FIG. 1 is a front quarter isometric view of a prior art open front refrigerated case.
Figure 2:
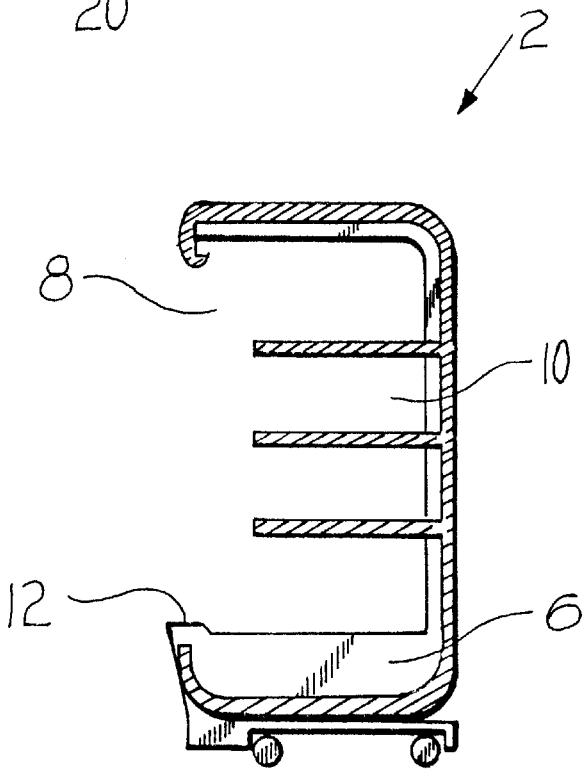
FIG 2 PRIOR ART
FIG. 2 is a side cross-sectional view of a prior art refrigerated case taken at section II—II of FIG. 1.
Figure 3:
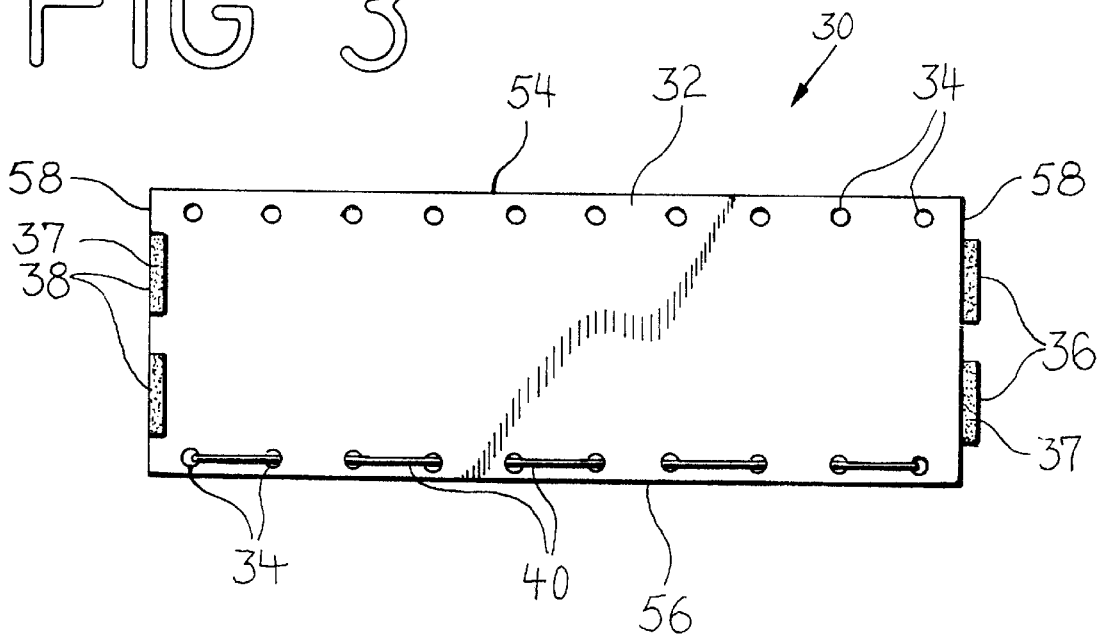
FIG. 3 is a front view of a cover incorporating lower eyelets and cord.

Referring now to FIG. 3 we observe a front view of cover 30. Cover 30 comprises cover sheet 32 having cover sheet upper edge 54, cover sheet lower edge 56 and cover sheet side edges 58. A plurality of eyelets 34 are disposed along cover sheet upper edge 54 and cover sheet lower edge 56. Cord 40 is woven through the eyelets disposed along cover sheet lower edge 56. Cord 40 is referred to as "cord" 40, although it is contemplated that any elongate member would serve, such as a rope, a chain, a cable, etc.

The cover 30 embodiment illustrated in FIG. 3 comprises at least one male end tab 36 disposed at one cover sheet side edge 58, and at least one female end tab 38 disposed at an opposite cover sheet side edge 58. The male end tab(s) 36 and female end tab(s) 38 comprise hook and loop material 37, or other fastening means. The cover 30 embodiment illustrated in FIG. 3 may be attached to a refrigerated case 2 having the appropriate hook and loop material 37 (or other appropriate mating fastening means) attached to its case sides 6. The cover 30 embodiment illustrated in FIG. 3 is also suitable for attachment to another adjacent cover 30, by attaching their respective corresponding male end tab(s) 36 and female end tab(s) 38. An alternate embodiment of cover 30 may comprise male end tab(s) 36 disposed at both cover sheet side edges 58, for easy attachment to mating hoop and loop material 37 (or other appropriate mating fastening means) attached to case sides 6. It is contemplated to be within the scope of this disclosure to pre-cut cover sheets 32 to size to fit specific refrigerated cases 2, to expedite installation.

Figure 5:
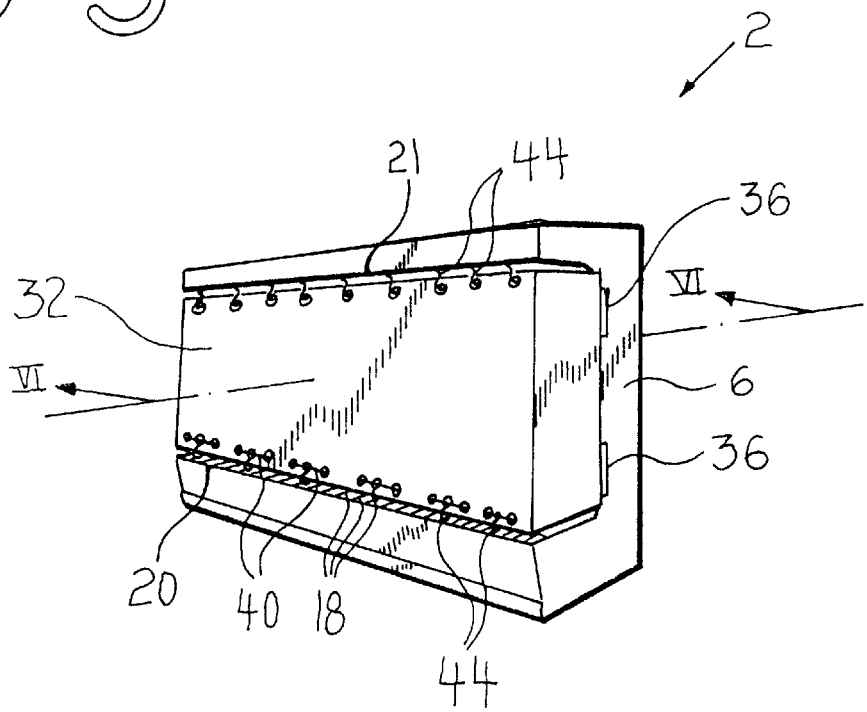
FIG. 5 is a front quarter isometric view of a refrigerated case with a cover installed.
Figure 6:
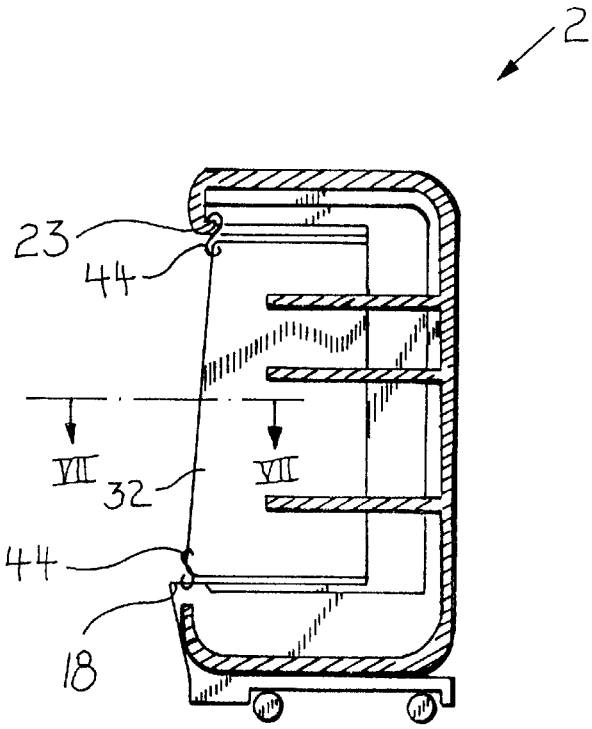
FIG. 6 side cross-sectional view of the refrigerated case with cover installed of FIG. 5 taken at section VI—VI of FIG. 5.

FIGS. 5 and 6 depict cover 30 attached to refrigerated case 2. Cover sheet upper edge 54 is removably attached to upper case front lower edge 21 by means of S hooks 44 sized to fit into eyelets 34 and over upper case front lip 23. Cover sheet lower edge 56 is removably attached to lower case front upper edge 20 by means of S hooks 44 sized to fit around cord 40 and around grille spokes 18. Cover sheet side edges 58 are removably attached to case sides 6 by means of male end tab(s) 36 or female end tab(s) 38 having hoop and loop material 37 (or other appropriate fastening means) engaged with mating hoop and loop material 37 (or other appropriate mating fastening means) attached to case sides 6.

In practice, in case of power failure, cover 30 may be quickly and easily attached to refrigerated case 2 by engaging S hooks 44 into the eyelets 34 disposed along cover sheet upper edge 54, and with upper case front lip 23. S hooks 44 are then used to attach cord 40 to grille spokes 18, and finally cover sheet side edges 58 are quickly attached to case sides 6 by means of male end tab(s) 36 or female end tab(s) 38 having hoop and loop material 37 (or other appropriate fastening means) and mating hoop and loop material 37 (or other appropriate mating fastening means) attached to case sides 6.

The removal of cover 30 involves simply reversing the above three steps. While cover 30 is installed on refrigerated case 2, dry ice may be added as required to maintain the correct temperature inside refrigerated case 2.

Figure 4:
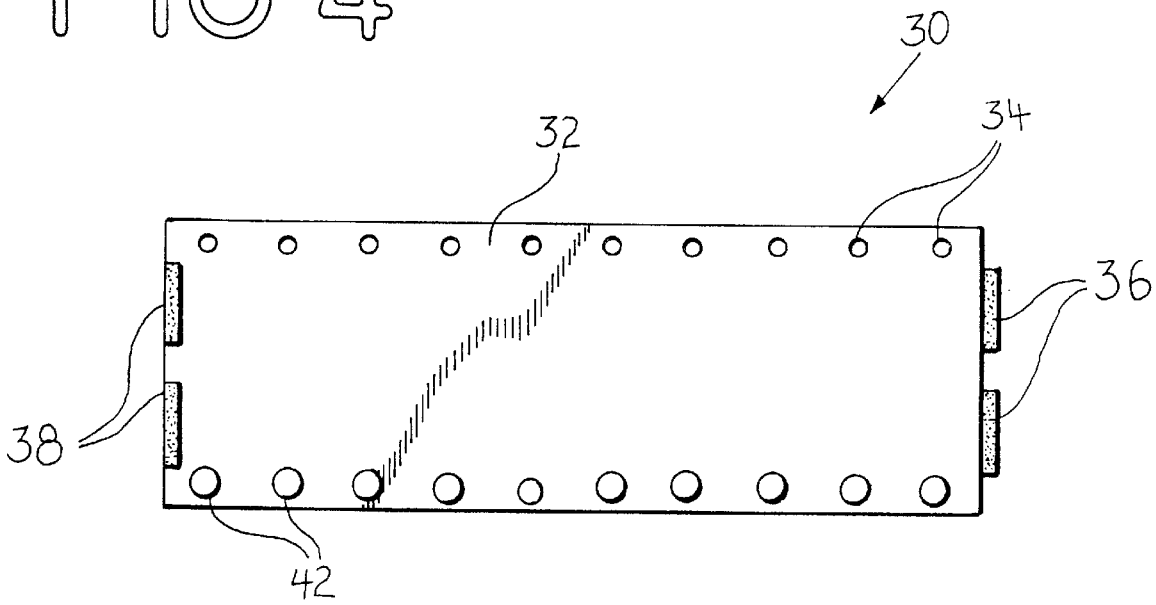
FIG. 4 is a front view of an alternate embodiment cover incorporating weights in lieu of lower eyelets and cord.

FIG. 4 is a front view of an alternate embodiment cover 30 incorporating weights 42 in lieu of lower eyelets 34 and cord 40. This alternate embodiment cover 30 is suitable for quick installation and removal under conditions where keeping customers out of the food is not necessary. For example, even absent any power failure, where a store closes overnight, significant energy savings could be derived by installing cover 30 on refrigerated case 2 when the store closes, and removing same the next morning when the store opens.

The alternate embodiment cover 30 depicted in FIG. 4 incorporates weights 42 along cover sheet lower edge 56 instead of cord 40 woven through eyelets 34, in order to expedite installation and removal of cover 30. As may be observed in FIG. 8, when cover 30 is installed on refrigerated case 2, weights 42 hold the bottom of cover sheet 32 against lower case front upper edge 20, thus keeping the cold air inside refrigerated case 2.

Figure 8:
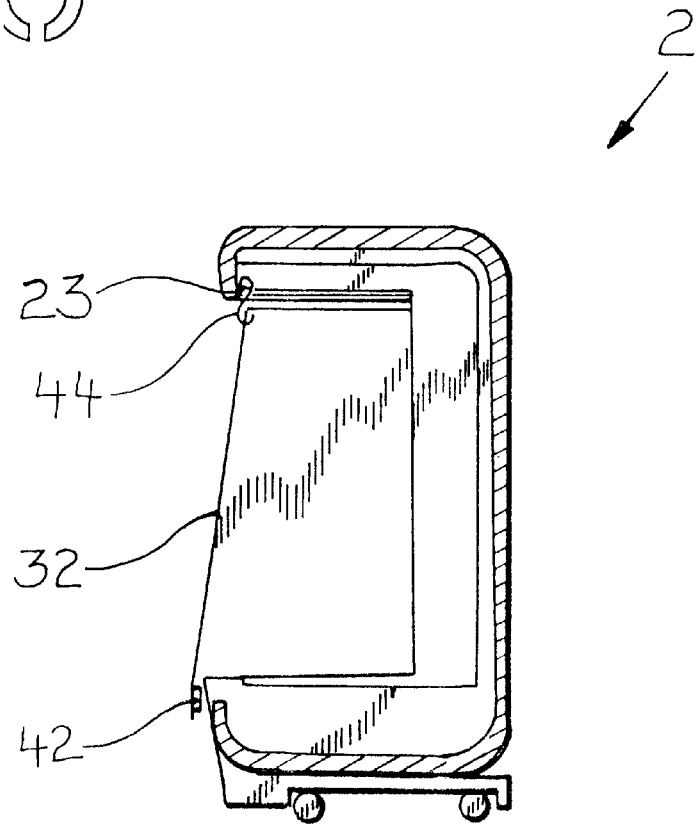
FIG. 8 is a side cross-sectional view of an alternate embodiment cover attached to a refrigerated case.

The alternate embodiment cover 30 depicted in FIGS. 4 and 8 is quickly installed by engaging S hooks 44 with the eyelets 34 disposed along cover sheet upper edge 54 with upper case front lip 23. Then, cover sheet side edges 58 are quickly attached to case sides 6 by means of male end tab(s) 36 or female end tab(s) 38 having hoop and loop material 37 (or other appropriate fastening means) and mating hoop and loop material 37 (or other appropriate mating fastening means) attached to case sides 6. Weights 42 hold the bottom of cover sheet 32 against lower case front upper edge 20, thus keeping the cold air inside refrigerated case 2.

The removal of the alternate embodiment cover 30 depicted in FIGS. 4 and 8 involves simply reversing the above two steps. During a power failure, while cover 30 is installed on refrigerated case 2, dry ice may be added as required to maintain the correct temperature inside refrigerated case 2.

Figure 7:
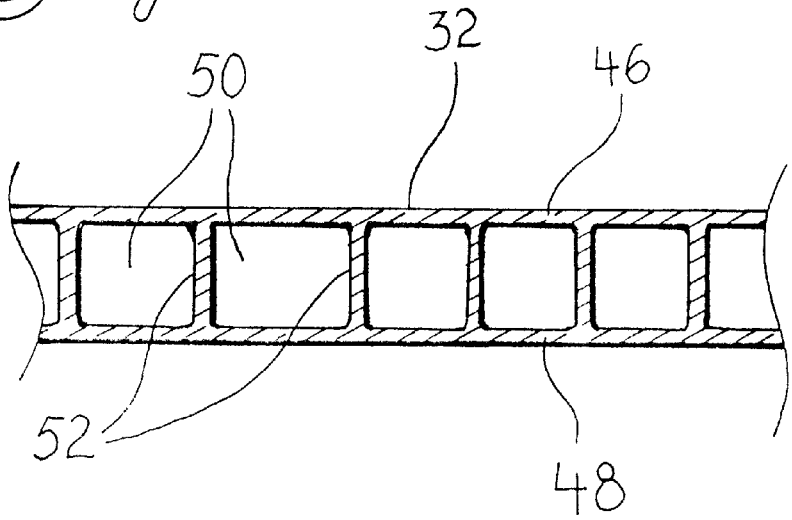
FIG. 7 is a top cross-sectional view of a cover sheet taken at section VII—VII of FIG. 6.

In the preferred embodiment, cover sheet 32 was made of air cells 50 sandwiched between outer cover sheet 46 and inner cover sheet 48. See FIG. 7. Outer cover sheet 46 and inner cover sheet 48 were approximately 99% aluminum. Air cells 50 were separated by air cell walls 52. This type of material is currently available commercially, under the trademark Reflectix™ Eyelets 34 were commercially available off-the-shelf eyelets made of brass, aluminum, stainless steel, metal synthetic, or other appropriate material. S hooks 44 were commercially available off8 the-shelf eyelets made of brass, aluminum, stainless steel, metal, synthetic, or other appropriate material. Cord 40 was cord, rope, chain, cable, or any appropriate flexible elongate member. Weights 42 were made of metal, synthetic, or any other appropriate material.

While a preferred embodiment of the invention has been illustrated herein, it is to be understood that changes and variations may be made by those skilled in the art without departing from the spirit of the appending claims.

DRAWING ITEM INDEX

2 refrigerated case
4 case front
6 case side
8 case front opening
10 case side opening
12 grille
14 shelves
16 grille apertures
18 grille spokes
20 lower case front upper edge
21 upper case front lower edge
23 upper case front lip
30 cover
32 cover sheet
34 eyelet
36 male end tab
37 hook and loop material
38 female end tab
40 cord
42 weight
44 S hook
46 outer cover sheet
48 inner cover sheet
50 air cells
52 air cell walls
54 cover sheet upper edge
56 cover sheet lower edge
58 cover sheet side edge

I claim:

1. A refrigerated case cover comprising a cover sheet, said cover sheet comprising a cover sheet upper edge, a cover sheet lower edge, and cover sheet side edges, eyelets disposed along said cover sheet upper edge and said cover sheet lower edge, a cord woven through said eyelets disposed along said cover sheet lower edge, means of attaching each said cover sheet side edge to a refrigerated case side, means of attaching said cover sheet upper edge to an upper case front lower edge, and means of attaching said cover sheet lower edge to a lower case front upper edge.

2. A refrigerated case cover comprising a cover sheet, said cover sheet comprising a cover sheet upper edge, a cover sheet lower edge, and cover sheet side edges, eyelets disposed along said cover sheet upper edge and said cover sheet lower edge, a cord woven through said eyelets disposed along said cover sheet lower edge, means of attaching each said cover sheet side edge to a refrigerated case side, means of attaching said cover sheet upper edge to an upper case front lower edge, and means of attaching said cover sheet lower edge to a lower case front upper edge, said cover sheet being made of insulating material comprising a plurality of air cells disposed between an outer cover sheet and an inner cover sheet, said air cells being separated by air cell walls.

3. The refrigerated case cover of claim 2 wherein said means of attaching said cover sheet upper edge to an upper case front lower edge comprises a plurality of S hooks sized to fit through said eyelets and over an upper case front lip, said S hooks attaching said eyelets disposed along said cover sheet upper edge to said upper case front lip.

4. The refrigerated case cover of claim 2 wherein said means of attaching each said cover sheet side edges to a refrigerated case side comprises at least one male tab attached to each said cover sheet side edge, said male tab comprising a fastening means, and a corresponding mating fastening means attached to each said case side.

5. The refrigerated case cover of claim 4 wherein said fastening means comprises hook and loop material.

6. The refrigerated case cover of claim 2 wherein said means of attaching said cover sheet lower edge to said lower case front upper edge comprises a plurality of S hooks sized to fit around said cord and around grille spokes disposed along said lower case front upper edge, said S hooks attaching said cord to said grille spokes.

7. A refrigerated case cover comprising a cover sheet, said cover sheet comprising a cover sheet upper edge, a cover sheet lower edge, and cover sheet side edges, eyelets disposed along said cover sheet upper edge, means of attaching each said cover sheet side edges to a refrigerated case side, means of attaching said cover sheet lower edge to a lower case front upper edge, and means of attaching said cover sheet upper edge to an upper case front lower edge.

8. The refrigerated case cover of claim 7 wherein said cover sheet is made of insulating material comprising a plurality of air cells disposed between an outer cover sheet and an inner cover sheet, said air cells being separated by air cell walls.

9. The refrigerated case cover of claim 8 wherein said means of attaching said cover sheet upper edge to an upper case front lower edge comprises a plurality of S hooks sized to fit through said eyelets and over an upper case front lip, said S hooks attaching said eyelets disposed along said cover sheet upper edge to said upper case front lip.

10. The refrigerated case cover of claim 8 wherein said means of attaching each said cover sheet side edges to a refrigerated case side comprises at least one male tab attached to each said cover sheet side edge, said male tab comprising a fastening means, and a corresponding mating fastening means attached to each said case side.

11. The refrigerated case cover of claim 10 wherein said fastening means comprises hook and loop material.

12. A method of use for a refrigerated case cover, said cover comprising a cover sheet, said cover sheet comprising a cover sheet upper edge, a cover sheet lower edge, and cover sheet side edges, eyelets disposed along said cover sheet upper edge and said cover sheet lower edge, a cord woven through said eyelets disposed along said cover sheet lower edge, at least one male tab having hook and loop material disposed on each said cover sheet side edge, S hooks through said eyelets disposed along said cover sheet upper edge, and S hooks around said cord, said method of use comprising the steps of:

A. Attaching said S hooks through said eyelets disposed along said cover sheet upper edge to an upper case front lip;

B. Attaching said S hooks around said cord to grille spokes disposed along a lower case front upper edge; and C. Attaching said male tab hook and loop material to corresponding hook and loop material disposed on refrigerated case sides.

13. The method of use for a refrigerated case cover of claim 12 comprising the further step of putting dry ice into said refrigerated case as necessary to maintain a desired temperature within said refrigerated case.

14. A method of use for a refrigerated case cover, said cover comprising a cover sheet, said cover sheet comprising a cover sheet upper edge, a cover sheet lower edge, and cover sheet side edges, eyelets disposed along said cover sheet upper edge, at least one male tab having hook and loop material disposed on each said cover sheet side edge, means of attaching said cover sheet lower edge to a lower case front upper edge, and S hooks through said eyelets disposed along said cover sheet upper edge, said method of use comprising the steps of:

A. Attaching said S hooks through said eyelets disposed along said cover sheet upper edge to an upper case front lip;

B. Attaching said male tab hook and loop material to corresponding hook and look material disposed on refrigerated case sides; and C. Employing said means of attaching said cover sheet lower edge to said lower case front upper edge to attach said cover sheet lower edge to said lower case front upper edge.

15. The method of use for a refrigerated case cover of claim 14 comprising the further step of putting dry ice into said refrigerated case as necessary to maintain a desired temperature within said refrigerated case.

16. A plurality of refrigerated case covers, each said refrigerated case cover comprising a cover sheet, said cover sheet comprising a cover sheet upper edge, a cover sheet lower edge, and cover sheet side edges, eyelets disposed along said cover sheet upper edge and said cover sheet lower edge, a cord woven through said eyelets disposed along said cover sheet lower edge, means of attaching each said cover sheet side edge either to an adjacent cover sheet or to a refrigerated case side, means of attaching said cover sheet upper edge to an upper case front lower edge, and means of attaching said cover sheet lower edge to a lower case front upper edge, said cover sheet being made of insulating material comprising a plurality of air cells disposed between an outer cover sheet and an inner cover sheet, said air cells being separated by air cell walls.

17. The plurality of refrigerated case covers of claim 16 wherein said means of attaching each said cover sheet side edge either to an adjacent cover sheet or to a refrigerated case side comprises hook and loop material.

18. A plurality of refrigerated case covers, each said refrigerated case cover comprising a cover sheet upper edge, a cover sheet lower edge, and cover sheet side edges, eyelets disposed along said cover sheet upper edge, means of attaching each said cover sheet side edges either to an adjacent cover sheet or to a refrigerated case side, means of attaching said cover sheet lower edge to a lower case front upper edge, and means of attaching said cover sheet upper edge to an upper case front lower edge.

19. The plurality of refrigerated case covers of claim 18 wherein said means of attaching each said cover sheet side edge either to an adjacent cover sheet or to a refrigerated case side comprises hook and loop material.

* * * * *